US009333752B2

(12) United States Patent
Horiguchi

(10) Patent No.: US 9,333,752 B2
(45) Date of Patent: May 10, 2016

(54) LIQUID JET HEAD, LIQUID JET APPARATUS, AND METHOD OF MANUFACTURING LIQUID JET HEAD

(71) Applicant: SII PRINTEK INC., Chiba-shi, Chiba (JP)

(72) Inventor: Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/509,673

(22) Filed: Oct. 8, 2014

(65) Prior Publication Data

US 2015/0109374 A1 Apr. 23, 2015

(30) Foreign Application Priority Data

Oct. 17, 2013 (JP) ..... 2013-216583

(51) Int. Cl.
*B41J 2/175* (2006.01)
*B41J 2/16* (2006.01)
*B41J 2/14* (2006.01)

(52) U.S. Cl.
CPC ..... *B41J 2/1632* (2013.01); *B41J 2/14209* (2013.01); *B41J 2/1609* (2013.01); *B41J 2/1623* (2013.01); *Y10T 29/42* (2015.01)

(58) Field of Classification Search
None
See application file for complete search history.

(56) References Cited

U.S. PATENT DOCUMENTS

| | | | | |
|---|---|---|---|---|
| 5,432,540 | A * | 7/1995 | Hiraishi | 347/69 |
| 5,625,393 | A * | 4/1997 | Asai | 347/69 |
| 2007/0030316 | A1 | 2/2007 | Watanabe | 347/68 |
| 2010/0141711 | A1 * | 6/2010 | Koseki | 347/65 |
| 2013/0162725 | A1 | 6/2013 | Suzuki et al. | 347/68 |

FOREIGN PATENT DOCUMENTS

| | | |
|---|---|---|
| JP | 2003505281 | 2/2003 |
| JP | 2011131539 | 7/2011 |

OTHER PUBLICATIONS

IPO Search Report mailed Apr. 17, 2015 issued in GB Patent Appln. No. GB1418496.4.

* cited by examiner

*Primary Examiner* — Erica Lin
(74) *Attorney, Agent, or Firm* — Adams & Wilks

(57) ABSTRACT

A liquid jet head includes a piezoelectric substrate having ejection grooves formed in an upper surface thereof and arranged in a reference direction. A side flow path is formed in a first side surface of the piezoelectric substrate and communicates with the ejection grooves. A cover plate is bonded to the upper surface, and a nozzle plate is bonded to the first side surface and has nozzles communicating with the respective ejection grooves.

15 Claims, 11 Drawing Sheets

(S21)

(S22)

(S3)

(S31)

(S4)

LIQUID JET HEAD, LIQUID JET APPARATUS, AND METHOD OF MANUFACTURING LIQUID JET HEAD

BACKGROUND

1. Technical Field

The present invention relates to a liquid jet head, a liquid jet apparatus, and a method of manufacturing a liquid jet head capable of ejecting droplets onto a recording medium for recording.

2. Related Art

An ink jet type liquid jet head used in recent years ejects ink droplets onto recording paper or the like to record characters or figures thereon, or ejects liquid material onto a surface of an element substrate to form a functional thin film. According to this system, liquid such as ink and liquid material is introduced to channels from a liquid tank via supply pipes. Then, the liquid is ejected from nozzles communicating with the channels with application of pressure to the liquid charged into the channels. In delivery of the liquid, the liquid jet head and/or the recording medium are shifted to record characters or figures, or to form a functional thin film having a predetermined shape.

A through flow type is known as this type of liquid jet head. The through flow type liquid jet head constantly circulates liquid contained within the channels by using a piezoelectric element for constituting walls defining the channels. The through flow type rapidly discharges bubbles or foreign matters to the outside of the channels when bubbles or foreign matters are mixed into the liquid. Accordingly, maintenance of the through flow type is allowed without the use of a cap structure or a service station. As a result, the consumption of the liquid during maintenance decreases, and the running cost lowers. In addition, wasteful consumption of a recording medium produced by inferior delivery decreases to the minimum.

JP 2003-505281 W discloses a liquid circulation type liquid jet head. FIG. 15A illustrates a liquid jet head disclosed in JP 2003-505281 W. A piezoelectric element includes two PZT wafers 30 and 32, and a polyimide sheet 38 sandwiched between the two PZT wafers 30 and 32. Grooves are formed in each inner surface of the PZT wafers 30 and 32. The respective grooves in the PZT wafer 30 face to the corresponding grooves in the PZT wafer 32 to define chambers 36. Electrodes 44 and 46 are provided on the side surfaces of the grooves of the PZT wafers 30 and 32, respectively. The electrodes 44 and 46 drive, in a shearing mode, side walls 48 formed between the adjoining chambers 36. Each of the chambers 36 is divided into an upper part and a lower part by the polyimide sheet 38. The polyimide sheet 38 is cut at ends 50 closest to nozzles 42. Liquid such as ink circulates from an upper chamber to a lower chamber as indicated by an arrow 52.

FIG. 15B is a perspective view illustrating another type of disassembled liquid jet head disclosed in JP 2003-505281 W. The liquid jet head includes PZT wafers 88 and 89, a mask plate 100, an opening plate 66, and a nozzle plate 64. The PZT wafers 88 and 89 are constituted by two piezoelectric elements overlapped with each other, and form three types of flow paths 90, 92, and 94. The mask plate 100 has openings communicating with the flow paths 90 and the flow paths 94, and closes the flow paths 92. The opening plate 66 has opening portions extending over the flow paths 92 and connecting the flow paths 90 and flow paths 94 such that the flow paths 90 and flow paths 94 can communicate with each other. The nozzle plate 64 has nozzles 102 communicating with the opening portions of the opening plate 66. Liquid flows from the flow paths 90 via the opening portions of the opening plate 66 toward the flow paths 94 as indicated by the arrow 52. In other words, liquid circulates around the flow paths 92. Line electrodes are provided on side surfaces of each pair of walls 96 and 98. The side surfaces of the walls 96 and 98 provided with the line electrodes are located on the flow path 92 side. On the other hand, earth electrodes are provided on the other side surfaces of each pair of the walls 96 and 98. The other side surfaces of the walls 96 and 98 provided with the earth electrodes are located on the flow paths 90 and 94 side. These line electrodes and earth electrodes drive the walls 96 and 98 to eject small droplets 49 from the nozzles 102.

JP 2011-131533 A discloses another type of liquid circulation type liquid jet head. This liquid jet head includes a piezoelectric plate, a cover plate, and a nozzle plate. The piezoelectric plate contains a plurality of grooves in the front surface of the piezoelectric plate. The cover plate is bonded to the front surface of the piezoelectric plate, and covers upper openings of the respective grooves. The nozzle plate is disposed on the side surface of the piezoelectric plate, and has a plurality of nozzles communicating with the respective grooves. The cover plate has a liquid supply hole to supply liquid to the respective grooves via the liquid supply hole. A plurality of discharge paths in correspondence with the respective grooves are formed in the front surface of the nozzle plate on the piezoelectric plate side. The liquid jet head further includes a flow path member disposed on the rear surface of the piezoelectric plate. The flow path member contains a liquid discharge chamber. The discharge paths formed in the nozzle plate connect the grooves formed in the front surface of the piezoelectric plate and the liquid discharge chamber formed in the rear surface of the piezoelectric plate such that the grooves and the liquid discharge chamber communicate with each other. Liquid flowing from the liquid supply hole branches into the respective grooves, passes from the respective grooves through the corresponding discharge paths, and joins at the liquid discharge chamber.

The piezoelectric elements of the liquid jet head shown in FIG. 15A requires the polyimide sheet 38 disposed between the two PZT wafers, and the cuts at the ends 50 of the polyimide sheet 38 at positions corresponding to the nozzle positions. This structure increases the number of parts, and requires alignment between the grooves formed in the two PZT wafers 30 and 32, and alignment of the cuts of the polyimide sheet 38 with the respective grooves. In this case, the number of parts increases, and the assembling steps become complicated. Moreover, the liquid jet head shown in FIG. 15B requires a plurality of the flow paths constituted by units of the flow paths 90, 92 and 94 and formed in the two PZT wafers overlapped with each other. The liquid jet head further requires the mask plate 100 on the end surfaces of the flow paths 90, 92, and 94, the opening plate 66 on the upper surface of the mask plate 100, and further the nozzle plate 64 on the upper surface of the opening plate 66. Accordingly, the liquid jet head shown in FIG. 15B is constituted by a large number of parts, and has a complicated structure requiring accurate alignment at the time of assembly. The liquid jet head disclosed in JP 2011-131533 A requires the same number of the discharge paths as the number of the nozzles, and forms the discharge paths in the front surface of the nozzle plate on the piezoelectric plate side with the same pitch as the pitch of the nozzles. In this case, the structure becomes complicated, and the manufacture becomes extremely difficult.

SUMMARY

A liquid jet head according to an aspect of the present invention includes: a piezoelectric substrate which includes ejection grooves formed in an upper surface of the piezoelectric substrate and arranged in a reference direction, and a side flow path formed in a first side surface of the piezoelectric substrate and communicating with the plurality of ejection grooves; a cover plate bonded to the upper surface; and a nozzle plate bonded to the first side surface and including nozzles communicating with the ejection grooves.

The piezoelectric substrate includes non ejection grooves arranged such that the ejection grooves and the non ejection grooves are alternately disposed. The non ejection grooves do not communicate with the side flow path.

The depth of the non ejection grooves from the upper surface is smaller than the corresponding depth of the ejection grooves.

The non ejection grooves extend from the first side surface of the piezoelectric substrate to a second side surface opposed to the first side surface.

The ejection grooves extend from the first side surface of the piezoelectric substrate to a position before the second side surface opposed to the first side surface.

The side flow path is opened to a lower surface of the piezoelectric substrate on the side opposite to the upper surface.

The side flow path extends between positions before a third side surface and a fourth side surface, the third side surface and the fourth side surface being disposed adjacent to the first side surface of the piezoelectric substrate and opposed to each other.

A first lower liquid chamber formed by a recessed portion is included in a lower surface of the piezoelectric substrate on the side opposite to the upper surface. The first lower liquid chamber communicates with the side flow path.

The cross-sectional shape of the side flow path in the direction perpendicular to the reference direction is expanded from the ejection grooves toward the lower surface on the side opposite to the upper surface.

A lower plate is included which contains a second lower liquid chamber communicating with the side flow path, and is bonded to a lower surface of the piezoelectric substrate on the side opposite to the upper surface.

The piezoelectric substrate includes a first piezoelectric substrate and a second piezoelectric substrate. The cover plate includes a first cover plate and a second cover plate. A lower surface of the first piezoelectric substrate and a lower surface of the second piezoelectric substrate are opposed and fixed to each other. A side flow path of the first piezoelectric substrate and a side flow path of the second piezoelectric substrate communicate with each other. The first cover plate is boded to an upper surface of the first piezoelectric substrate. The second cover plate is bonded to an upper surface of the second piezoelectric substrate.

The lower surface of the first piezoelectric substrate and the lower surface of the second piezoelectric substrate are bonded to each other.

A lower plate is provided between the first piezoelectric substrate and the second piezoelectric substrate. The lower plate includes a second lower liquid chamber communicating with the side flow path.

The arrangement pitch of the ejection grooves of the first piezoelectric substrate in the reference direction is equalized with the arrangement pitch of the ejection grooves of the second piezoelectric substrate in the reference direction. The respective arrangement pitches deviate from each other in the reference direction by the half of the pitch for each.

A method of manufacturing a liquid jet head according to another aspect of the present invention includes: a groove forming step forming ejection grooves in an upper surface of a piezoelectric substrate in a reference direction; a side flow path forming step forming a side flow path in a first side surface of the piezoelectric substrate in such a manner as to allow the side flow path to communicate with the plurality of ejection grooves; a cover plate bonding step bonding a cover plate to the upper surface; and a nozzle plate bonding step bonding a nozzle plate to the first side surface.

The groove forming step forms the ejection grooves and non ejection grooves in the upper surface of the piezoelectric substrate such that the ejection grooves and the non ejection grooves are alternately disposed in the reference direction.

The groove forming step forms the ejection grooves and the non ejection grooves such that the depth of the ejection grooves from the upper surface becomes larger than the corresponding depth of the non ejection grooves.

The side flow path forming step starts grinding from a lower surface of the piezoelectric substrate on the side opposite to the upper surface.

The side flow path forming step starts grinding from the first side surface of the piezoelectric substrate.

A conductive material depositing step is included which deposits a conductive material on side surfaces of the ejection grooves.

A first piezoelectric substrate and a second piezoelectric substrate both formed by the piezoelectric substrate are provided. The side flow path forming step forms a side flow path in each of first side surfaces of the first piezoelectric substrate and the second piezoelectric substrate. A depositing step is included which laminates the first piezoelectric substrate and the second piezoelectric substrate on each other and fixes these substrates to each other in such a manner that the respective first side surfaces of the first piezoelectric substrate and the second piezoelectric substrate are flush with each other, and that lower surfaces of the first piezoelectric substrate and the second piezoelectric substrate on the side opposite to the upper surfaces face to each other.

A liquid jet apparatus according to a further aspect of the present invention includes the liquid jet head described above; a shift mechanism shifting the liquid jet head and a recording medium relatively to each other; a liquid supply pipe supplying liquid to the liquid jet head; and a liquid tank supplying the liquid to the liquid supply pipe.

A liquid jet head according to the present invention includes: a piezoelectric substrate which includes ejection grooves formed in an upper surface of the piezoelectric substrate and arranged in a reference direction, and a side flow path formed in a first side surface of the piezoelectric substrate and communicating with the plurality of ejection grooves; a cover plate bonded to the upper surface; and a nozzle plate bonded to the first side surface and including nozzles communicating with the ejection grooves. Accordingly, the liquid jet head provided according to the present invention is a liquid circulation type liquid jet head constituted by a smaller number of constituent elements, and easy to be assembled.

DETAILED DESCRIPTION (First Embodiment)

Figure 1A:
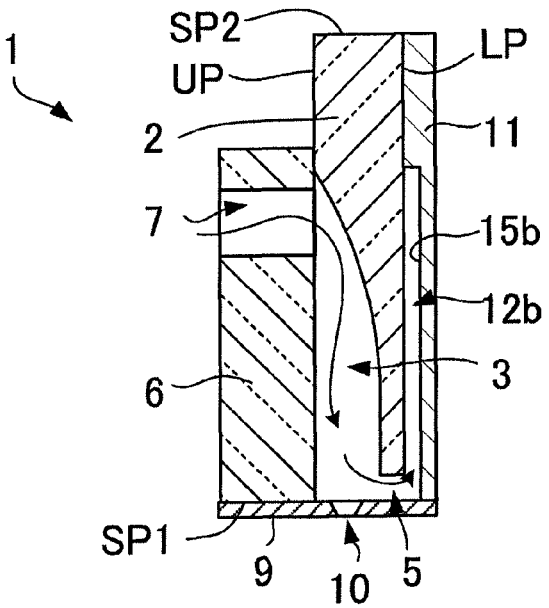
FIGS. 1A to 1C illustrate a liquid jet head according to a first embodiment of the present invention.
Figure 1B:
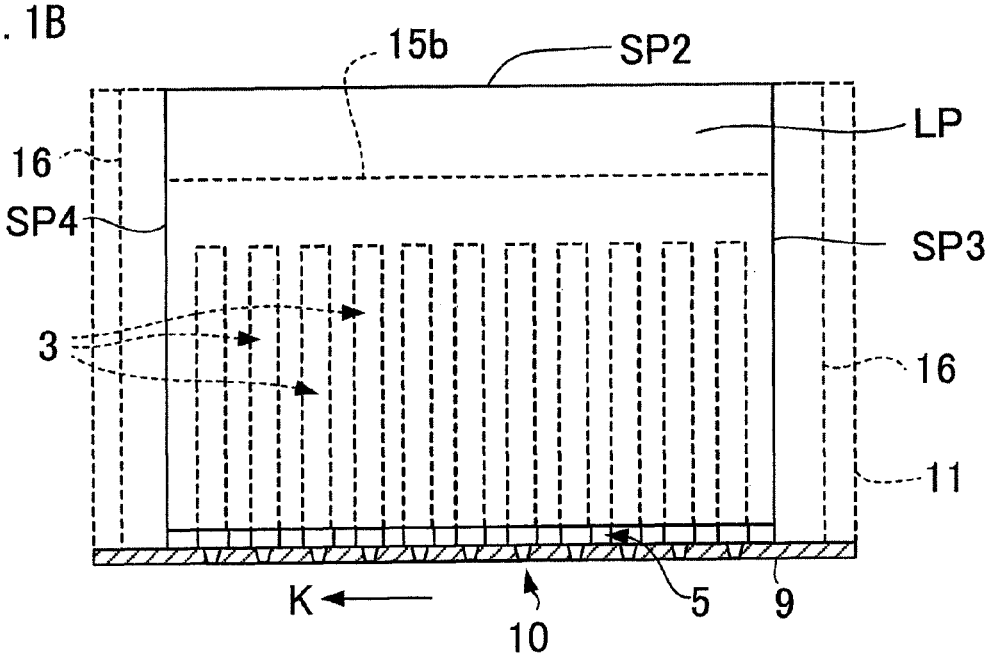
Figure 1C:
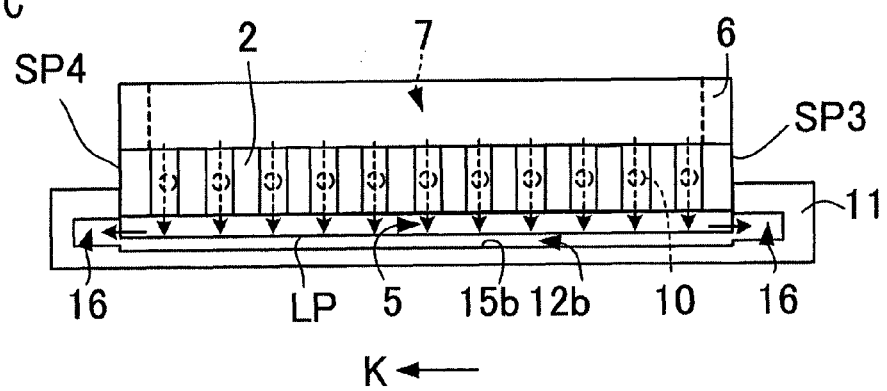

FIGS. 1A to 1C illustrate a liquid jet head 1 according to a first embodiment of the present invention. FIG. 1A is a cross-sectional view schematically illustrating an ejection groove 3 of the liquid jet head 1 in a groove direction. FIG. 1B is a plan view schematically illustrating the liquid jet head 1 from which a lower plate 11 is removed as viewed from a lower surface LP side. FIG. 1C is a front view schematically illustrating the liquid jet head 1 from which a nozzle plate 9 is removed as viewed from a first side surface SP1.

The liquid jet head 1 includes a piezoelectric substrate 2, a cover plate 6 bonded to an upper surface UP of the piezoelectric substrate 2, the nozzle plate 9 bonded to the first side surface SP1 of the piezoelectric substrate 2, and the lower plate 11 bonded to the lower surface LP on the side opposite to the upper surface UP of the piezoelectric substrate 2. The piezoelectric substrate 2 includes the ejection grooves 3 arranged in the upper surface UP in a reference direction K, and further includes a side flow path 5 formed in the first side surface SP1 and communicating with the plurality of ejection grooves 3. The cover plate 6 includes an upper liquid chamber 7 communicating with the ejection grooves 3. The nozzle plate 9 includes nozzles 10 communicating with the ejection grooves 3. The lower plate 11 includes a lower liquid chamber 12*b* communicating with the side flow path 5. (The lower liquid chamber 12*b* corresponds to a second lower liquid chamber. This applies to the corresponding parts in the following description.) According to this structure, liquid flowing from the cover plate 6 into the ejection grooves 3 enters the side flow path 5 in the vicinity of the nozzles 10, and flows out of the piezoelectric substrate 2. Accordingly, the liquid jet head 1 is a liquid circulation type liquid jet head constituted by a smaller number of constituent elements, and easy to be assembled.

More specific points are hereinafter clarified. Material of the piezoelectric substrate 2 used herein may be PZT ceramics, or other types of piezoelectric materials. The piezoelectric substrate 2 is polarized in the vertical direction of the upper surface UP. The piezoelectric substrate 2 may be a chevron type piezoelectric substrate constituted by a lamination of a piezoelectric material polarized in the vertical direction of the upper surface UP, and a piezoelectric material polarized in the opposite direction. The ejection grooves 3 extend from the first side surface SP1 to a position before a second side surface SP2 opposed to the first side surface SP1. The ejection grooves 3 and the side flow path 5 may be formed by using a dicing blade. For example, the ejection grooves 3 may be formed by grinding in the vertical direction of the upper surface UP. On the other hand, the side flow path 5 may be formed by grinding in the vertical direction of the first side surface SP1 or the lower surface LP by using a dicing blade. Accordingly, the side flow path 5 communicating with the ejection grooves 3 can be easily formed.

Not-shown drive electrodes are provided on both the side surfaces of the ejection grooves 3 to drive side walls. Not-shown terminals are equipped on the upper surface UP of the piezoelectric substrate 2 on the second side surface SP2 side. These terminals are configured to supply driving signals. For example, droplets are allowed to be ejected from the ejection grooves 3 by three-cycle driving.

The cover plate 6 may be made of PZT ceramics, other types of ceramics, metal, glass material, or plastics, for example. The nozzle plate 9 may be made of polyimide film, other types of plastic film, or a metal plate, for example. The upper liquid chamber 7 formed in the cover plate 6 communicates with the respective ejection grooves 3. The plurality of nozzles 10 are formed in the nozzle plate 9. Each of the plurality of nozzles 10 communicates with the corresponding one of the plurality of ejection grooves 3. The lower plate 11 may be made of ceramics, metal, plastics, or glass material, for example. The lower plate 11 projects in the reference direction K from a third side surface SP3 of the piezoelectric substrate 2 crossing the first side surface SP1, and from a fourth side surface SP4 opposed to the third side surface SP3. A lower flow path 16 is formed within the projected portion of the lower plate 11. The lower flow path 16 is a path through which liquid is discharged from the lower liquid chamber 12*b*. A recessed portion 15*b* is formed in the lower plate 11 on the piezoelectric substrate 2 side. The lower liquid chamber 12*b* is defined by the recessed portion 15*b* and the lower surface LP. The lower liquid chamber 12*b* communicates with the side flow path 5 throughout the length of the lower liquid chamber 12*b* in the reference direction K. The lower flow path 16 connects with the lower liquid chamber 12*b* in the reference direction K to discharge liquid toward the second side surface SP2.

The liquid jet head 1 operates in the manner as follows. Initially, liquid is supplied to the upper liquid chamber 7. Liquid enters the respective ejection grooves 3 as indicated by arrows, and flows toward the nozzle plate 9. Then, the liquid enters the side flow path 5 from the respective ejection grooves 3 before reaching the first side surface SP1, and flows out in the reference direction K. In this condition, driving signals are applied between the drive electrodes of the corresponding ejection groove 3 and the drive electrodes of the adjoining two ejection grooves 3 to deform, in a shearing mode, two side walls between which the corresponding ejection groove 3 is sandwiched. For example, the volume of the ejection groove 3 is instantaneously expanded to introduce liquid from the upper liquid chamber 7. Then, the volume of the ejection groove 3 is instantaneously returned to the original volume. By this method, pressure waves are generated in the liquid contained in the ejection groove 3, so that droplets can be ejected from the corresponding nozzle 10.

Figure 2:
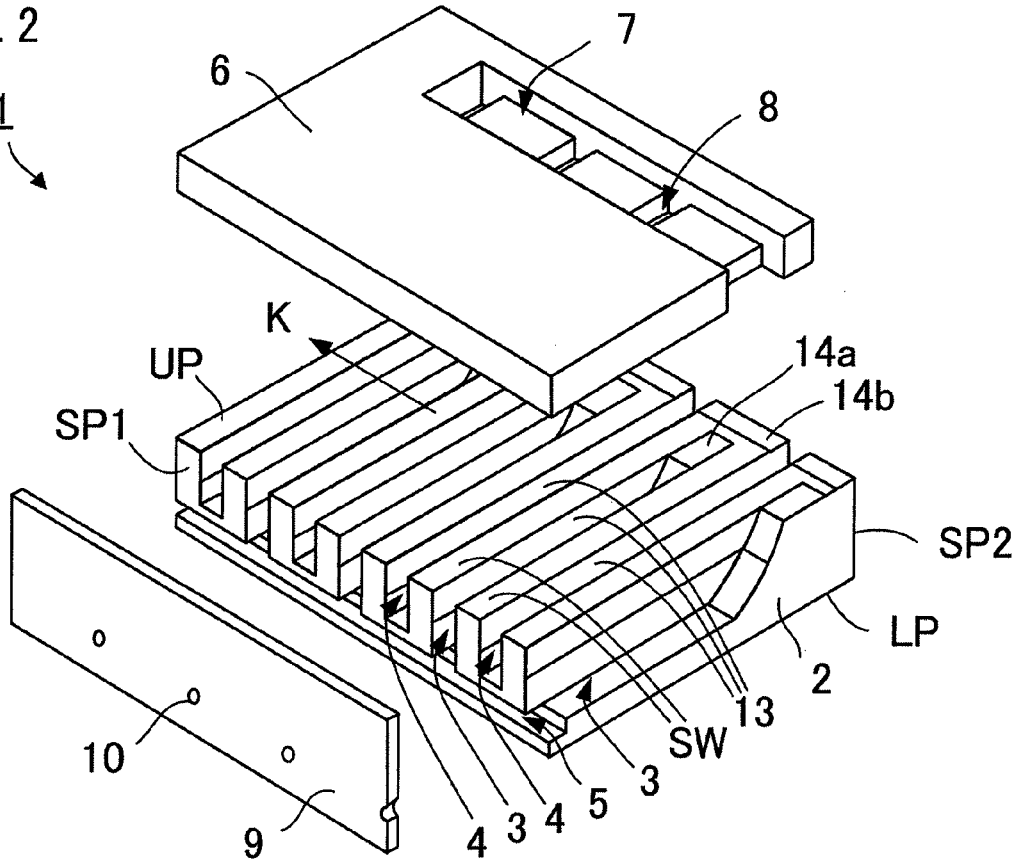
FIG. 2 is a perspective view schematically illustrating a disassembled liquid jet head according to a second embodiment of the present invention.

(Second Embodiment) FIG. 2 is a perspective view schematically illustrating the disassembled liquid jet head 1 according to a second embodiment of the present invention. The liquid jet head 1 includes the piezoelectric substrate 2, the cover plate 6 bonded to the upper surface UP of the piezoelectric substrate 2, and the nozzle plate 9 bonded to the first side surface SP1 of the piezoelectric substrate 2. The piezoelectric substrate 2 has the ejection grooves 3 and non ejection grooves 4 alternately arranged in the upper surface UP in the reference direction K. The piezoelectric substrate 2 further includes the side flow path 5 disposed in the first side surface SP1. The side flow path 5 communicates with the plurality of ejection grooves 3, but does not communicate with the non ejection grooves 4. The cover plate 6 includes the upper liquid chamber 7 communicating with the ejection grooves 3. The nozzle plate 9 includes the nozzles 10 communicating with the ejection grooves 3. According to this structure, liquid flowing from the cover plate 6 into the ejection grooves 3 enters the side flow path 5 in the vicinity of the nozzles 10, and flows out of the piezoelectric substrate 2. Accordingly, the liquid jet head 1 is a liquid circulation type liquid jet head constituted by a smaller number of constituent elements, and easy to be assembled.

More specific points are hereinafter clarified. Material of the piezoelectric substrate 2 used herein may be PZT ceramics, or other types of piezoelectric materials. The piezoelectric substrate 2 is polarized in the vertical direction of the upper surface UP. The piezoelectric substrate 2 may be a chevron type piezoelectric substrate constituted by a lamination of a piezoelectric material polarized in the vertical direction of the upper surface UP, and a piezoelectric material polarized in the opposite direction. The ejection grooves 3 extend from the first side surface SP1 to a position before the second side surface SP2 opposed to the first side surface SP1. The non ejection grooves 4 extend from the first side surface SP1 to the second side surface SP2. The non ejection grooves 4 have a smaller depth from the upper surface UP than the corresponding depth of the ejection grooves 3. The ejection grooves 3, the non ejection grooves 4, and the side flow path 5 may be formed by using a dicing blade. For example, the ejection grooves 3 and the non ejection grooves 4 may be formed by grinding in the vertical direction of the upper surface UP. On the other hand, the side flow path 5 may be formed by grinding in the vertical direction of the first side surface SP1 by using a dicing blade. Accordingly, the side flow path 5 communicating with the ejection grooves 3 and not communicating with the non ejection grooves 4 can be easily formed.

Drive electrodes 13 are provided on both side surfaces of the ejection grooves 3 and on both side surfaces of the non ejection grooves 4. The drive electrodes 13 drive side walls SW. Individual terminals 14*b* are provided on the upper surface UP of the piezoelectric substrate 2 on the second side surface SP2 side. Common terminals 14*a* are provided on the upper surface UP between the individual terminals 14*b* and the ejection grooves 3. Each of the common terminals 14*a* electrically connects with the drive electrodes 13 provided on both side surfaces of the corresponding ejection groove 3. Each of the individual terminals 14*b* electrically connects the drive electrodes 13 provided on the two side surfaces of the two adjoining non ejection grooves 4 between which the corresponding ejection groove 3 is sandwiched. These two side surfaces of the two adjoining non ejecting grooves 4 are located on the corresponding ejection groove 3 side. When driving signals are applied to the common terminals 14*a* and the individual terminals 14*b*, the two side walls SW formed between the corresponding ejection groove 3 and the two non ejection grooves 4 between which the corresponding ejection groove 3 is sandwiched deform in a shearing mode, whereby the volume of the ejection groove 3 varies.

The cover plate 6 may be made of PZT ceramics, other types of ceramics, glass material, metal, or plastics, for example. The nozzle plate 9 may be made of polyimide film, other types of plastic film, or a metal plate, for example. The upper liquid chamber 7 is provided in the cover plate 6. A plurality of slits 8 are formed in the upper liquid chamber 7. The slits 8 penetrate the upper liquid chamber 7 in the plate thickness direction. Each of the plurality of slits 8 communicates with the corresponding one of the plurality of ejection grooves 3. The plurality of nozzles 10 are formed in the nozzle plate 9. Each of the plurality of nozzles 10 communicates with the corresponding one of the plurality of ejection grooves 3. The non ejection grooves 4 opened to the first side surface SP1 and the respective opening portions of the side flow path 5 are closed by the nozzle plate 9.

The liquid jet head 1 operates in the manner as follows. Initially, liquid is supplied to the upper liquid chamber 7. The liquid enters the respective ejection grooves 3 via the respective slits 8, and flows toward the nozzle plate 9. Then, the liquid enters the side flow path 5 from the respective ejection grooves 3 before reaching the first side surface SP1, and flows out in the reference direction K. In this condition, driving signals are applied to the common terminals 14*a* and the individual terminals 14*b* to deform, in the shearing mode, the two side walls SW between which the corresponding ejection groove 3 is sandwiched. Initially, the volume of the ejection groove 3 is instantaneously expanded to introduce liquid from the upper liquid chamber 7. Then, the volume of the ejection groove 3 is instantaneously returned to the original volume. By this method, pressure waves are generated in the liquid contained in the ejection groove 3, so that droplets can be ejected from the corresponding nozzle 10.

(Third Embodiment)

Figure 3:
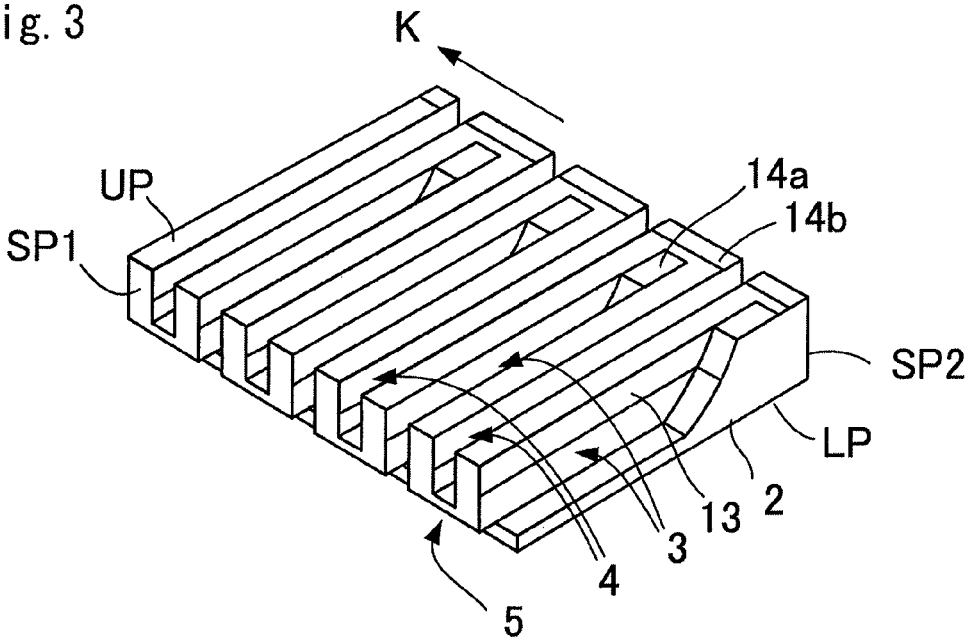
FIG. 3 is a perspective view schematically illustrating a piezoelectric substrate of a liquid jet head according to a third embodiment of the present invention.

FIG. 3 is a perspective view schematically illustrating the piezoelectric substrate 2 of the liquid jet head 1 according to a third embodiment of the present invention. The piezoelectric substrate 2 in this embodiment is different from the piezoelectric substrate 2 in the second embodiment in the shape of the side flow path 5. Other configurations are similar to the corresponding configurations in the second embodiment. The different points between this embodiment and the second embodiment are hereinafter discussed, and similar points are not repeatedly explained. Similar parts or parts having similar functions are given similar reference numbers.

As illustrated in FIG. 3, the flow path 5 is formed in the first side surface SP1 of the ejection grooves 3. The flow path 5 communicates with the plurality of ejection grooves 3, but does not communicate with the non ejection grooves 4. The side flow path 5 is opened to the lower surface LP of the piezoelectric substrate 2 on the side opposite to the upper surface UP. Liquid flowing from the ejection grooves 3 is introduced in the reference direction K, and flows out toward the lower surface LP. Accordingly, the flow path resistance of the liquid in the side flow path 5 decreases. As a result, the conditions of the liquid flowing in the respective ejection grooves 3 are equalized.

(Fourth Embodiment)

Figure 4:
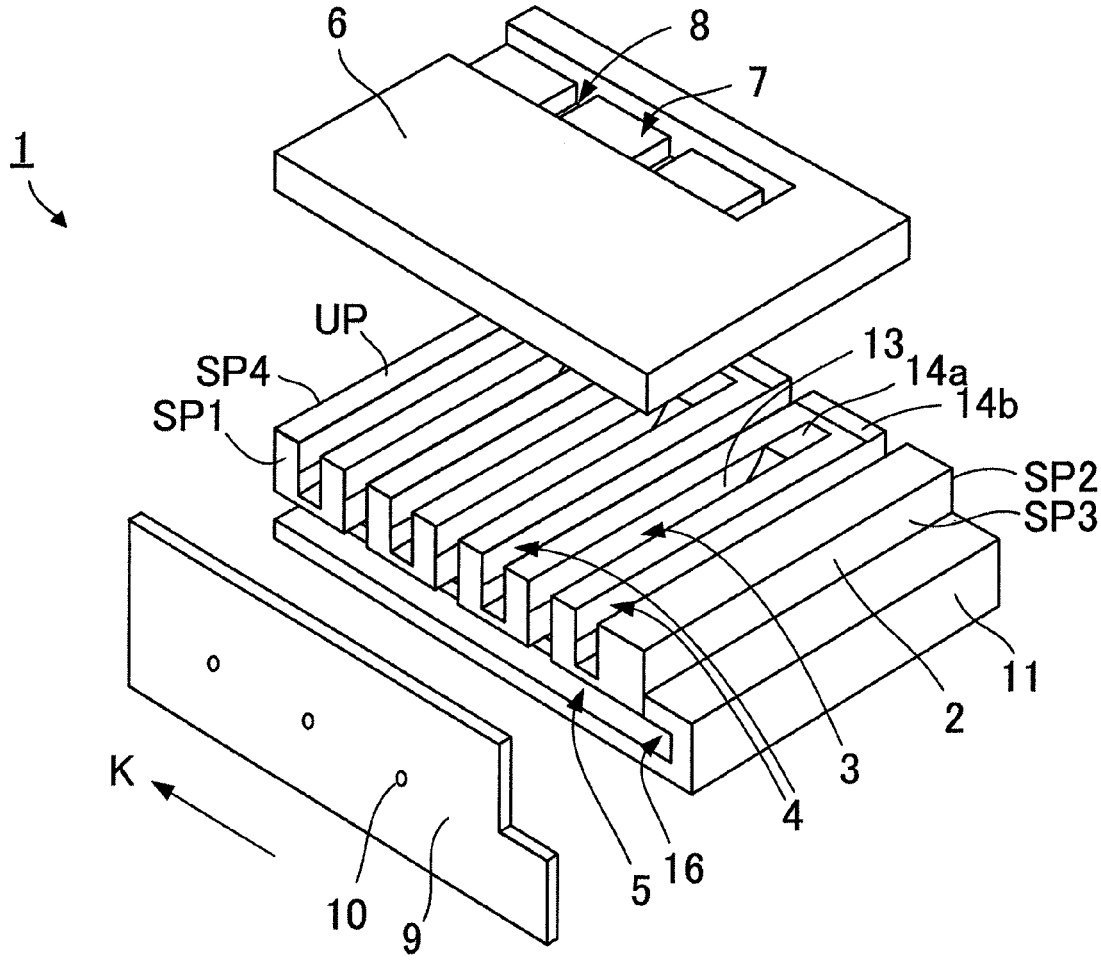
FIG. 4 is a perspective view schematically illustrating a disassembled liquid jet head according to a fourth embodiment of the present invention.
Figure 5A:
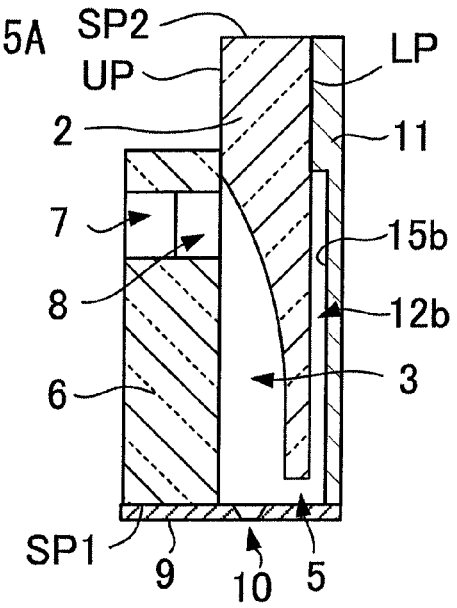
FIGS. 5A to 5D illustrate the liquid jet head according to the fourth embodiment of the present invention.
Figure 5B:
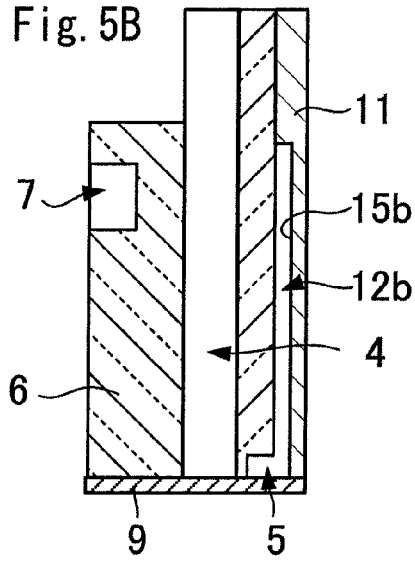
Figure 5C:
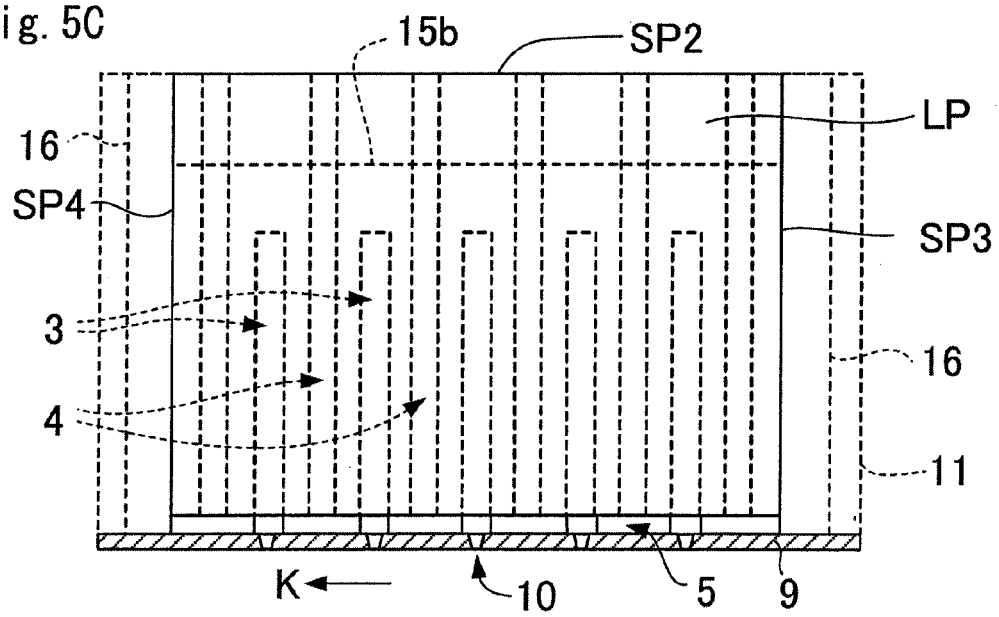
Figure 5D:
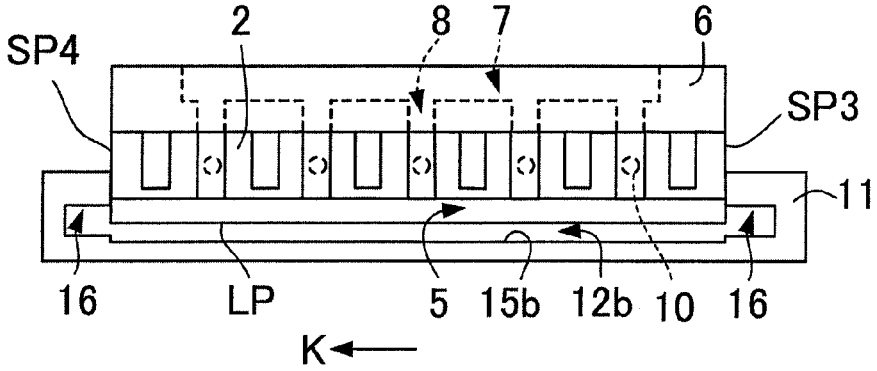

FIG. 4 and FIGS. 5A to 5D illustrate the liquid jet head 1 according to a fourth embodiment of the present invention. FIG. 4 is a perspective view schematically illustrating the disassembled liquid jet head 1. FIG. 5A is a cross-sectional view schematically illustrating the ejection groove 3. FIG. 5B is a cross-sectional view schematically illustrating the non ejection groove 4. FIG. 5C is a plan view schematically illustrating the liquid jet head 1 from which the lower plate 11 is removed as viewed from the lower surface LP side. FIG. 5D is a front view schematically illustrating the liquid jet head 1 from which the nozzle plate 9 is removed as viewed from the first side surface SP1. According to the liquid jet head 1 in this embodiment, the lower plate 11 is provided on the lower surface LP side of the piezoelectric substrate 2 of the third embodiment. Other configurations are similar to the corresponding configurations in the third embodiment. Similar parts or parts having similar functions are given similar reference numbers.

As illustrated in FIG. 4 and FIGS. 5A to 5D, the liquid jet head 1 includes the piezoelectric substrate 2, the cover plate 6 bonded to the upper surface UP of the piezoelectric substrate 2, the nozzle plate 9 bonded to the first side surface SP1 of the piezoelectric substrate 2, and the lower plate 11 bonded to the lower surface LP of the piezoelectric body 2 on the side opposite to the upper surface UP. The piezoelectric substrate 2 has the ejection grooves 3 and the non ejection grooves 4 alternately arranged in the upper surface UP in the reference direction K. The piezoelectric substrate 2 further includes the side flow path 5 formed in the first side surface SP1. The side flow path 5 communicates with the plurality of ejection grooves 3, but does not communicate with the non ejection grooves 4. The side flow path 5 is opened to the lower surface UP. The cover plate 6 includes the upper liquid chamber 7 communicating with the ejection grooves 3. The nozzle plate 9 includes the nozzles 10 communicating with the ejection grooves 3.

The lower plate 11 includes the lower liquid chamber 12*b* communicating with the side flow path 5, and the lower flow path 16 communicating with the lower liquid chamber 12*b*. The lower plate 11 projects in the reference direction K from the third side surface SP3 of the piezoelectric substrate 2 crossing the first side surface SP1, and from the fourth side surface SP4 opposed to the third side surface SP3. The lower flow path 16 is formed within the projected portion of the lower plate 11. The lower flow path 16 is a path through which liquid is discharged from the lower liquid chamber 12*b*. The recessed portion 15*b* is formed in the lower plate 11 on the piezoelectric substrate 2 side. The lower liquid chamber 12*b* is defined by the recessed portion 15*b* and the lower surface LP. The lower liquid chamber 12*b* communicates with the side flow path 5 throughout the length of the lower liquid chamber 12*b* in the reference direction K. The lower flow path 16 connects with the lower liquid chamber 12*b* in the reference direction K to discharge liquid toward the second side surface SP2.

Accordingly, the liquid flowing from the respective ejection grooves 3 crosses the side flow path 5 and enters the lower liquid chamber 12*b*. Then, the liquid is discharged into the lower flow path 16. Accordingly, the cross-sectional area of the flow path in the range from the side flow path 5 to the lower flow path 16 increases in comparison with the corresponding range in the second embodiment. This structure reduces the difference between the flow path resistance in the region of the ejection grooves 3 positioned in the vicinity of the center along a line in the reference direction K, and the flow path resistance in the region from the ejection grooves 3 positioned in the vicinity of both ends to the lower flow path 16. As a result, the pressure and flow rate of the liquid in the respective ejection grooves 3 are equalized, wherefore variations of the delivery conditions decrease.

Fifth Embodiment

Figure 6A:
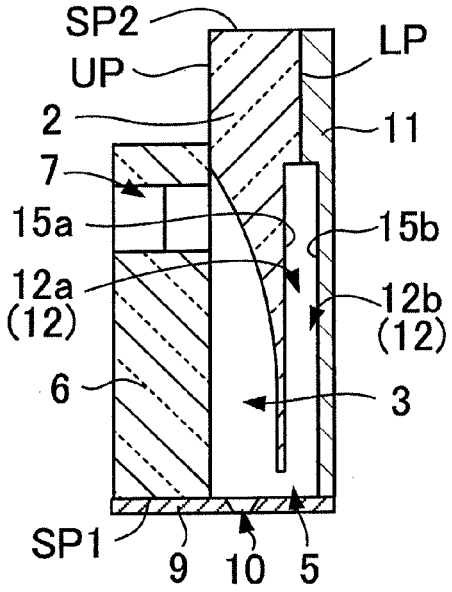
FIGS. 6A and 6B are cross-sectional views schematically illustrating a liquid jet head according to a fifth embodiment of the present invention.
Figure 6B:
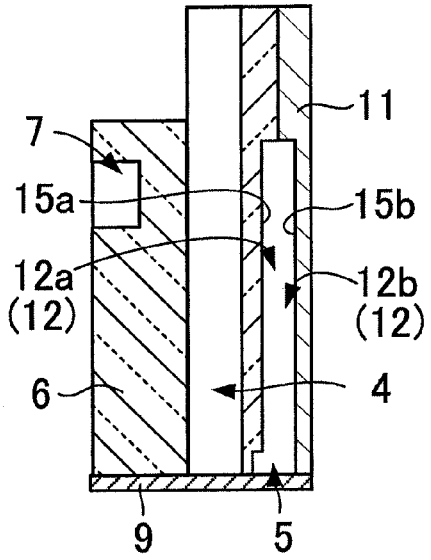

FIGS. 6A and 6B are cross-sectional views schematically illustrating the liquid jet head 1 according to a fifth embodiment of the present invention. FIG. 6A is a cross-sectional view schematically illustrating the ejection groove 3, while FIG. 6B is a cross-sectional view schematically illustrating the non ejection groove 4. This embodiment is different from the fourth embodiment in that a recessed portion 15*a* is formed in the lower surface LP of the piezoelectric substrate 2. Other configurations in this embodiment are similar to the corresponding configurations in the fourth embodiment. Similar parts or parts having similar functions are given similar reference numbers.

As illustrated in FIGS. 6A and 6B, there is provided a lower liquid chamber 12*a* constituted by the recessed portion 15*a* formed in the lower surface LP of the piezoelectric substrate 2. (The lower liquid chamber 12*a* corresponds to a first lower liquid chamber. This applies to the corresponding parts in the following description.) The lower liquid chamber 12*a* communicates with the side flow path 5. The lower liquid chamber 12*a* of the lower surface LP constitutes a lower liquid chamber 12 together with the lower liquid chamber 12*b* constituted by the recessed portion 15*b* formed in the lower plate 11. This structure increases the volume of the lower liquid chamber 12, wherefore the flow path resistance generated between the side flow path 5 and the lower flow path 16 decreases. When the flow path resistance at the recessed portion 15*a* is sufficiently low, the recessed portion 15*b* of the lower plate 11 may be eliminated.

(Sixth Embodiment)

Figure 7A:
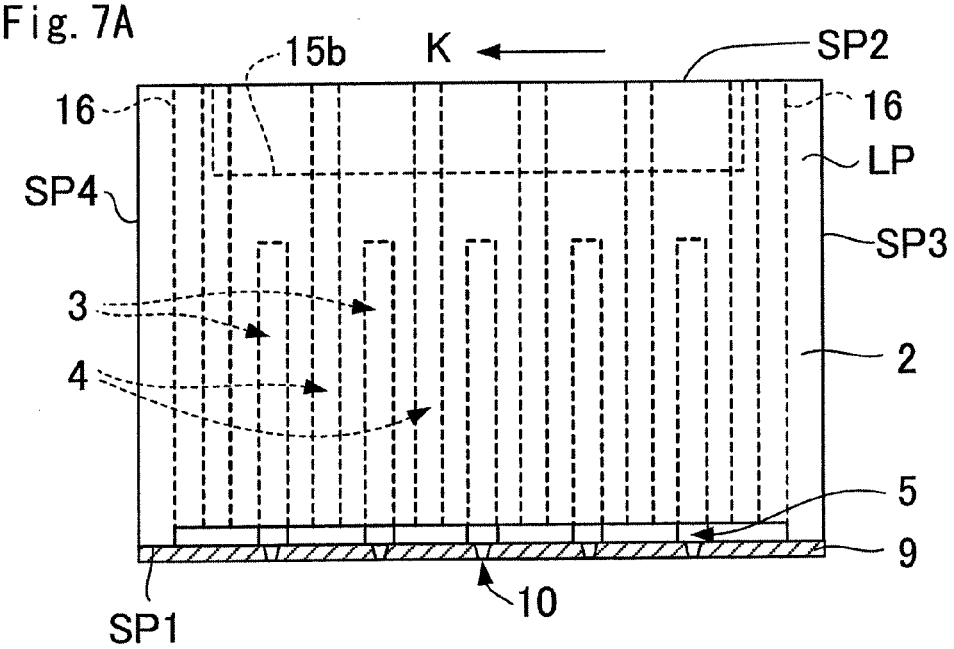
FIGS. 7A and 7B illustrate a liquid jet head according to a sixth embodiment of the present invention.
Figure 7B:
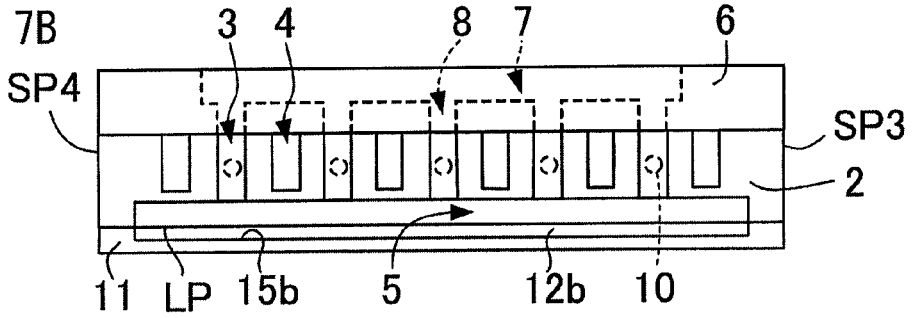

FIGS. 7A and 7B illustrate the liquid jet head 1 according to a sixth embodiment of the present invention. FIG. 7A is a plan view schematically illustrating the liquid jet head 1 from which the lower plate 11 is removed as viewed from the lower surface LP. FIG. 7B is a front view schematically illustrating the liquid jet head 1 from which the nozzle plate 9 is removed as viewed from the first side surface SP1. This embodiment is different from the fourth embodiment in the shapes of the side flow path 5 and the lower plate 11. Other configurations in this embodiment are similar to the corresponding configurations in the fourth embodiment. Accordingly, the different points between this embodiment and the fourth embodiment are hereinafter discussed, and similar points are not repeatedly explained. Similar parts or parts having similar functions are given similar reference numbers.

As illustrated in FIGS. 7A and 7B, the side flow path 5 is formed in the first side surface SP1 of the piezoelectric substrate 2. The side flow path 5 communicates with the plurality of ejection grooves 3, but does not communicate with the non ejection grooves 4. The side flow path 5 is opened to the lower surface LP of the piezoelectric substrate 2. The side flow path 5 extends from a position before the third side surface SP3 crossing the first side surface SP1, to a position before the fourth side surface SP4 opposed to the third side surface SP3. The ends of the lower plate 11 in the reference direction K are formed in such shapes as to be flush with the third side surface SP3 and the fourth side surface SP4 of the piezoelectric substrate 2. The recessed portion 15*b* constituting the lower liquid chamber 12*b* extends to positions before the third side surface SP3 and the fourth side surface SP4 to have the same length as the length of the side flow path 5 in the reference direction K. Accordingly, the side flow path 5 communicates with the lower liquid chamber 12*b* throughout the length of the side flow path 5 in the reference direction K. Liquid flowing from the respective ejection grooves 3 crosses the side flow path 5, and enters the lower liquid chamber 12*b*. Then, the liquid is discharged into a not-shown lower flow path.

Accordingly, the lower plate 11 does not project from the piezoelectric substrate 2 in the reference direction K, and the liquid jet head 1 becomes compact. Moreover, similarly to the third through fourth embodiments, the pressure and the flow rate of the liquid in the respective ejection grooves 3 are equalized along a line in the reference direction K. Accordingly, variations of the delivery conditions decrease. The lower plate 11 may project from the piezoelectric substrate 2 in the reference direction K similarly to the fourth embodiment.

(Seventh Embodiment)

Figure 8:
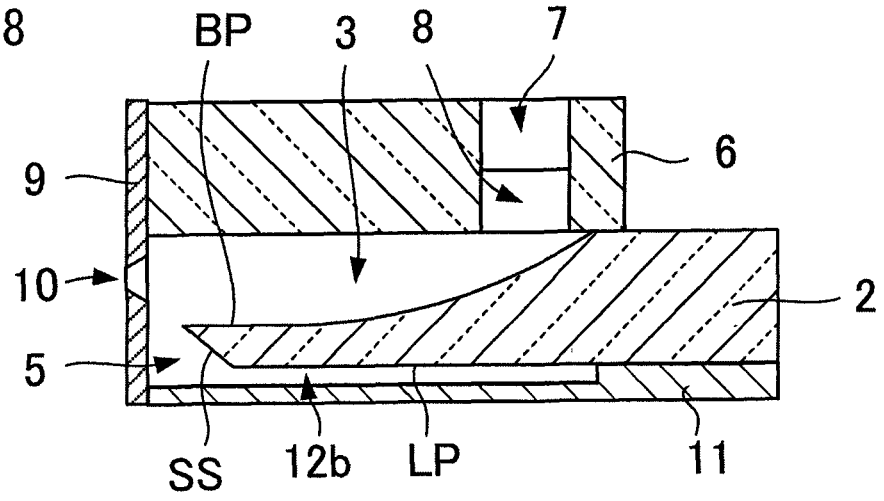
FIG. 8 is a cross-sectional view schematically illustrating a liquid jet head according to a seventh embodiment of the present invention.

FIG. 8 is a cross-sectional view schematically illustrating the liquid jet head 1 according to a seventh embodiment of the present invention. The piezoelectric substrate 2 in this embodiment is different from the piezoelectric substrates 2 in the third through sixth embodiments in the cross-sectional shape of the side flow path 5 formed in the first side surface SP1. Similar parts or parts having similar functions are given similar reference numbers.

As illustrated in FIG. 8, the cross-sectional shape of the side flow path 5 in the direction perpendicular to the reference direction K is expanded from the ejection groove 3 toward the lower surface LP. In other words, a bottom surface BP of the ejection groove 3 crosses a side surface SS of the side flow path 5 at an acute angle. This structure reduces the opening area of the ejection groove 3 in the vicinity of the nozzle 10, i.e., the opening area of the side flow path 5 opened to the ejection groove 3. In addition, this structure reduces leakage of pressure waves at the time of delivery of droplets, and prevents increase in the flow path resistance in the side flow path 5. Other configurations in this embodiment are similar to the corresponding configurations in the third through sixth embodiments.

The configuration of the side surface SS is not limited to the configuration shown in FIG. 8 More specifically, while the bottom surface BP of the ejection groove 3 crosses the side surface SS of the side flow path 5 at an acute angle in FIG. 8, the side surface SS may cross the bottom surface BP of the ejection groove 3 at an obtuse angle. In this case, flow of liquid from the ejection groove 3 toward the side flow path 5 becomes smooth. Accordingly, foreign matters such as bubbles can be effectively removed from the area around the nozzle 10.

(Eighth Embodiment)

Figure 9:
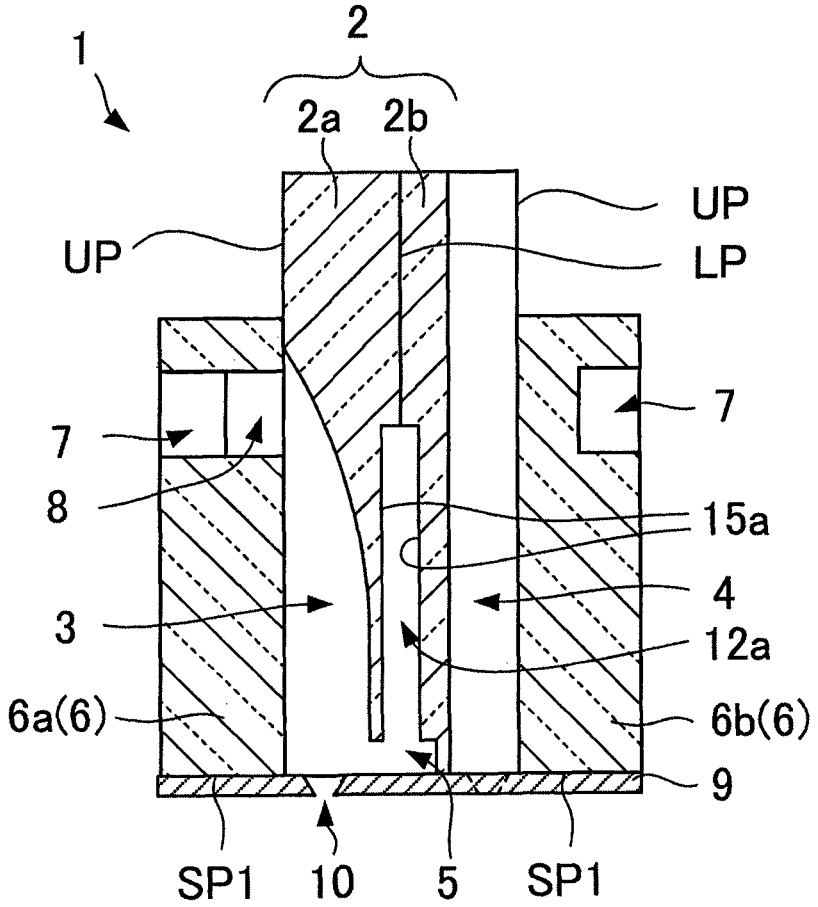
FIG. 9 is a cross-sectional view schematically illustrating a liquid jet head according to an eighth embodiment of the present invention.

FIG. 9 is a cross-sectional view schematically illustrating the liquid jet head 1 according to an eighth embodiment of the present invention. According to this embodiment, the lower surfaces LP of the two piezoelectric substrates 2 are bonded to increase the recording density. Similar parts or parts having similar functions are given similar reference numbers.

A first piezoelectric substrate 2*a* and a first cover plate 6*a* bonded to the upper surface UP of the first piezoelectric substrate 2*a*, and a second piezoelectric substrate 2*b* and a second cover plate 6*b* bonded to the upper surface UP of the second piezoelectric substrate 2*b* have similar configurations as the corresponding configurations of the piezoelectric substrate 2 and the cover plate 6 bonded to the upper surface UP of the piezoelectric substrate 2 discussed in the fifth embodiment. More specifically, the piezoelectric substrate 2 has the ejection grooves 3 and the non ejection grooves 4 alternately arranged in the upper surface UP in the reference direction K. The piezoelectric substrate 2 further includes the side flow path 5 disposed in the first side surface SP1. The side flow path 5 communicates with the ejection grooves 3, but does not communicate with the non ejection grooves 4. The cover plate 6 includes the upper liquid chamber 7. The upper liquid chamber 7 communicates with the respective ejection grooves 3 via the slits 8. Moreover, the lower surface LP of the piezoelectric substrate 2 includes the lower liquid chamber 12*a* constituted by the recessed portion 15*a*. The lower liquid chamber 12*a* communicates with the side flow path 5.

As illustrated in FIG. 9, the liquid jet head 1 includes the first piezoelectric substrate 2*a* and the second piezoelectric substrate 2*b* as the piezoelectric substrate 2, and further includes the first cover plate 6*a* and the second cover plate 6*b* as the cover plate 6. The lower surface LP of the first piezoelectric substrate 2*a* and the lower surface LP of the second piezoelectric substrate 2*b* are disposed opposed to each other and fixed to each other. The side flow path 5 of the first piezoelectric substrate 2*a* communicates with the side flow path 5 of the second piezoelectric substrate 2*b*. The lower liquid chamber 12*a* is constituted by the recessed portion 15*a* of the first piezoelectric substrate 2*a*, and the recessed portion 15*a* of the second piezoelectric substrate 2*b*. The first cover plate 6*a* is bonded to the upper surface UP of the first piezoelectric substrate 2*a*, while the second cover plate 6*b* is bonded to the upper surface UP of the second piezoelectric substrate 2*b*. Not-shown lower plates are bonded to the third side surface SP3 and the fourth side surface SP4 opposed to the third side surface SP3 of each of the first and second piezoelectric substrates 2*a* and 2*b*. Not-shown lower flow paths formed inside the lower plates communicate with the lower liquid chamber 12*a* and the side flow path 5. In addition, the arrangement pitch of the ejection grooves 3 of the first piezoelectric substrate 2*a* in the reference direction K is equalized with the arrangement pitch of the ejection grooves 3 of the second piezoelectric substrate 2*b* in the reference direction K. These pitches deviate from each other in the reference direction K by the half of the pitch for each. However, the ejection grooves 3 of the first piezoelectric substrate 2*a* and the ejection grooves 3 of the second piezoelectric substrate 2*b* may be bonded to each other without deviation in the reference direction K.

When liquid is supplied to the two upper liquid chambers 7 of the first and second cover plates 6*a* and 6*b*, liquid flows into the ejection grooves 3 of the first and second piezoelectric substrates 2*a* and 2*b* via the slits 8. Then, the liquid flows out into the lower liquid chamber 12*a* via the side flow path 5, and is discharged to the outside from the two lower flow paths of the not-shown lower plates.

Accordingly, the structure of the liquid jet head 1 constituted by the overlapped two piezoelectric substrates 2 increases the recording density in the reference direction K. According to this embodiment, the lower surfaces LP of the first piezoelectric substrate 2*a* and the second piezoelectric substrate 2*b* are bonded to each other. Alternatively, a lower plate may be provided between the lower surface LP of the first piezoelectric substrate 2*a* and the lower surface LP of the second piezoelectric substrate 2*b*. In this case, the lower plate contains a lower liquid chamber communicating with the side flow path 5 of the first and second piezoelectric substrates 2*a* and 2*b*, and a lower flow path communicating with the lower liquid chamber can be provided.

According to the second embodiment through the eighth embodiment, the ejection grooves 3 and the non ejection grooves 4 are alternately provided in the upper surface UP of the piezoelectric substrate 2 in the reference direction K. However, only the ejection grooves 3 may be provided in the reference direction K in these embodiments similarly to the first embodiment. In this case, all the ejection grooves 3 communicate with the side flow path 5. The upper liquid chamber 7 communicates with all the ejection grooves 3 without forming the slits 8 in the cover plate 6. The nozzles 10 are formed in the nozzle plate 9 at the corresponding positions of the non ejection grooves 4.

(Ninth Embodiment)

Figure 10:
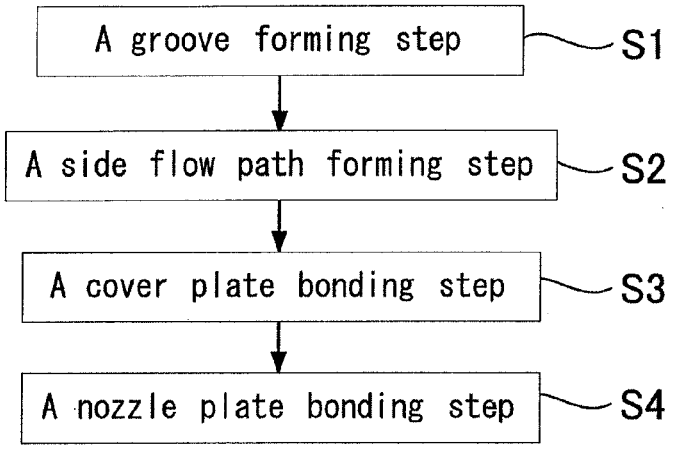
FIG. 10 is a flowchart showing a method of manufacturing a liquid jet head according to a ninth embodiment of the present invention.

FIG. 10 is a flowchart showing a method of manufacturing the liquid jet head 1 according to a ninth embodiment of the present invention. The flowchart shown in FIG. 10 describes a basic manufacturing method of the liquid jet head 1 according to the present invention.

Initially, ejection grooves are formed in the upper surface of a piezoelectric substrate in a groove forming step S1. The piezoelectric substrate used herein may be a substrate made of PZT ceramics or other types of piezoelectric material. The piezoelectric substrate is polarized uniformly in the vertical direction of the upper surface. In addition, the piezoelectric substrate may be constituted by a chevron type piezoelectric substrate. The ejection grooves may be formed by grinding the upper surface of the piezoelectric substrate in the vertical direction using a dicing blade which contains abrasive grains such as diamonds embedded in the outer circumference of a blade.

In a side flow path forming step S2, a side flow path communicating with the plurality of ejection grooves is formed in a first side surface of the piezoelectric substrate. Similarly to the formation of the ejection grooves, the side flow path may be formed by grinding the first side surface in the vertical direction, or grinding the lower surface on the side opposite to the upper surface using a dicing blade.

The side surface SS shown in FIG. 8 in the seventh embodiment can be formed by tilting the dicing blade at a predetermined angle. In forming the bottom surface BP of the ejection grooves 3 and the side surface SS of the side flow path 5 crossing each other at an acute angle, the blade is tilted toward the second side surface SP2 for grinding. In forming the bottom surface BP of the ejection grooves 3 and the side surface SS of the side flow path 5 crossing at an obtuse angle, the blade is tilted toward the first side surface SP1 for grinding.

In a cover plate bonding step S3, a cover plate is bonded to the upper surface of the piezoelectric substrate, and channels constituted by the ejection grooves are formed in the upper surface of the piezoelectric substrate. In a nozzle plate bonding step S4, a nozzle plate is bonded to the first side surface of the piezoelectric substrate. The non ejection grooves and the side flow path opened to the first side surface are closed by the nozzle plate. Accordingly, the side flow path for liquid circulation can be easily formed without considerably increasing the number of parts.

In the groove forming step S1, the ejection grooves 3 and the non ejection grooves 4 may be alternately formed in the upper surface UP of the piezoelectric substrate 2 in the reference direction K. When the ejection grooves 3 are formed more deeply than the non ejection grooves 4 in the first side surface SP1 in the groove forming step S1, the side flow path 5 communicating with the ejection grooves 3 and not communicating with the ejection grooves 4 can be easily formed in the first side surface SP1.

(Tenth Embodiment)

Figure 11:
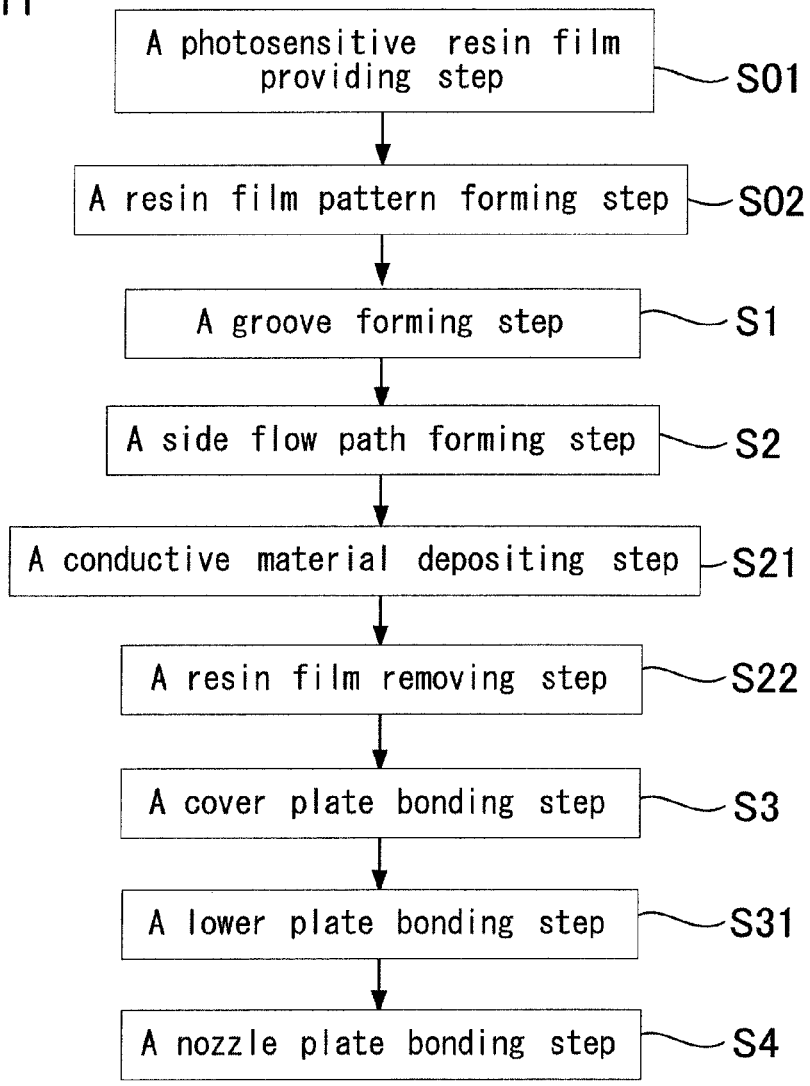
FIG. 11 is a flowchart showing a method of manufacturing a liquid jet head according to a tenth embodiment of the present invention.
Figure 12:
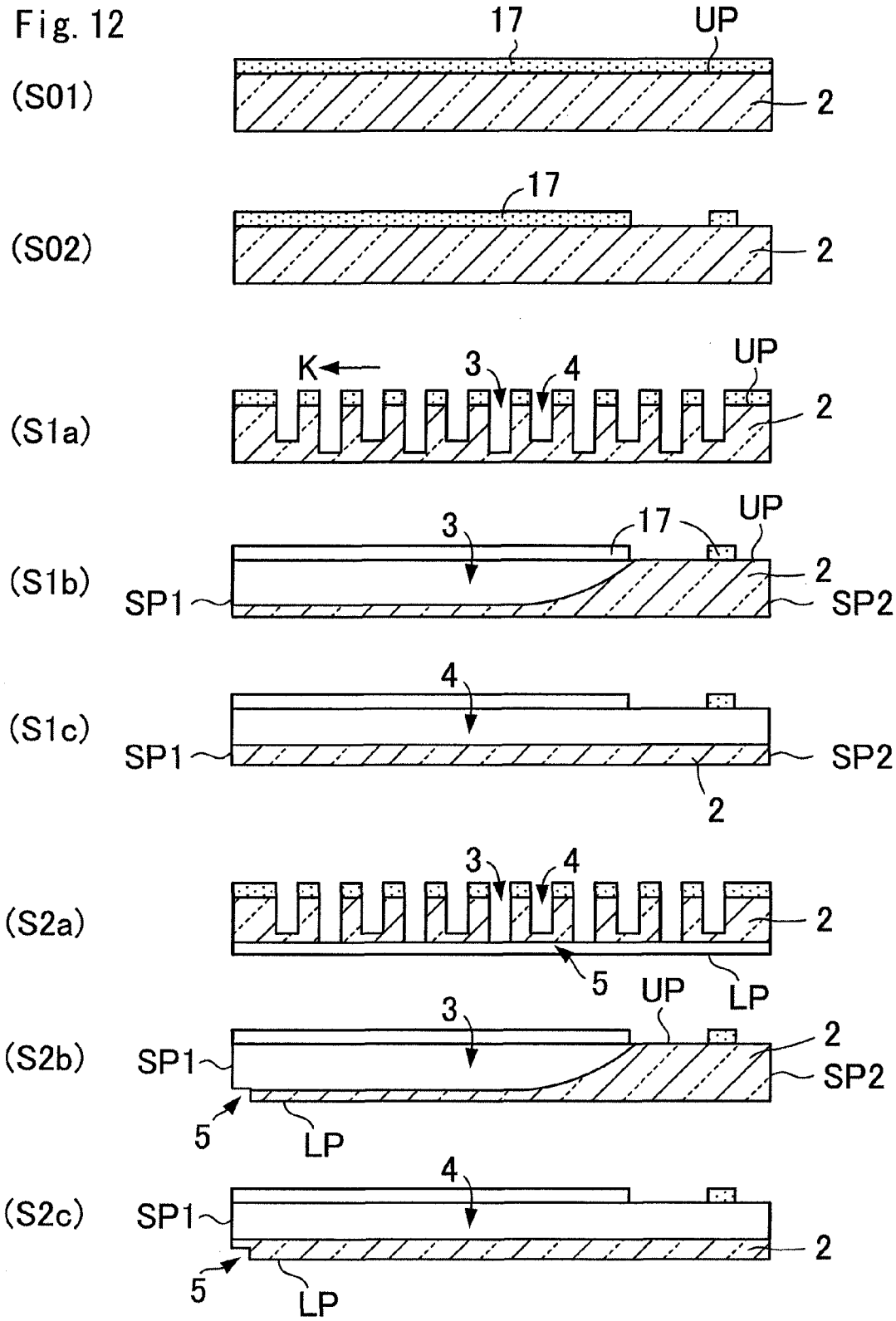
FIG. 12 illustrates manufacturing process steps of a liquid jet head according to a tenth embodiment of the present invention.
Figure 13:
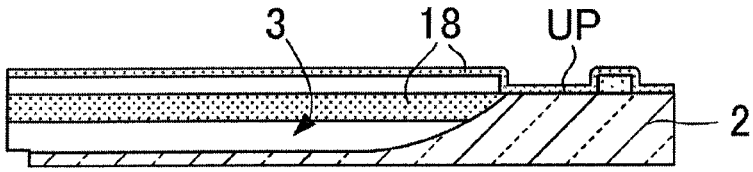
FIG. 13 illustrates manufacturing process steps of the liquid jet head according to the tenth embodiment of the present invention.
Figure 13:
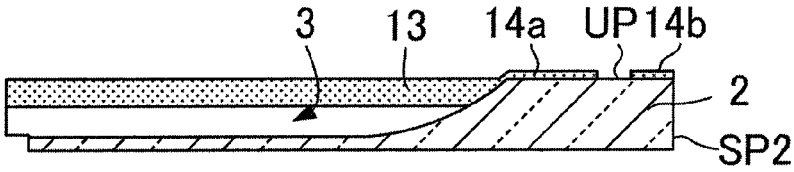
Figure 13:
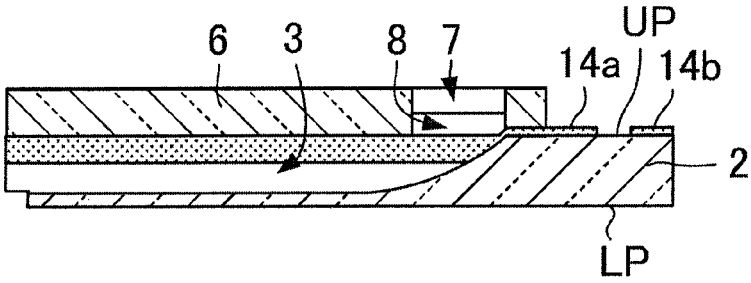
Figure 13:
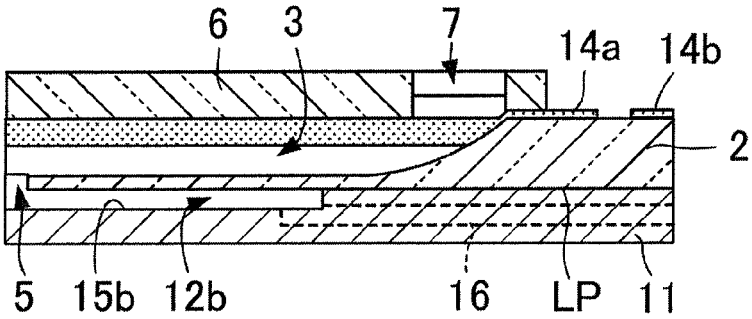
Figure 13:
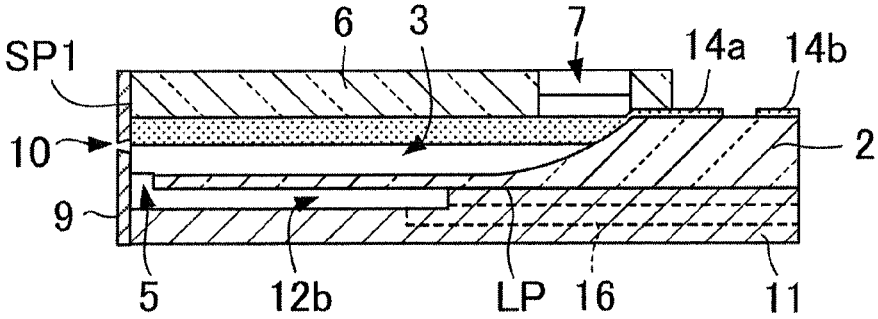

FIG. 11 is a flowchart showing a method of manufacturing a liquid jet head according to a tenth embodiment of the present invention. FIG. 12 and FIG. 13 describe respective manufacturing process steps.

Initially, in a photosensitive resin film providing step S01, a photosensitive resin film 17 is provided on the upper surface UP of the piezoelectric substrate 2 as illustrated in (S01) in FIG. 12. Material of the piezoelectric substrate 2 used herein may be PZT ceramics, or other types of piezoelectric materials. Material of the photosensitive resin film 17 may be a resist film, for example. In a resin film pattern forming step S02, the photosensitive resin film 17 is exposed and developed to form patterns of the photosensitive resin film 17 as illustrated in (S02) in FIG. 12. The photosensitive resin film 17 is removed from the area where the ejection grooves 3 and the non ejection grooves 4 are formed, and from the area where the common terminals 14*a* and the individual terminals 14*b* are formed.

In the groove forming step S1, the ejection grooves 3 and the non ejection grooves 4 are alternately formed in the upper surface UP of the piezoelectric substrate 2 in the reference direction K as illustrated in (S1*a*), (S1*b*), and (S1*c*) in FIG. 12. (S1*a*) in FIG. 12 is a front view schematically illustrating the piezoelectric substrate 2 as viewed from the first side surface SP1. (S1*b*) in FIG. 12 is a cross-sectional view schematically illustrating the ejection groove 3 in the groove direction. (S1*c*) in FIG. 12 is a cross-sectional view schematically illustrating the non ejection groove 4 in the groove direction. The respective grooves may be formed by grinding using a dicing blade. The ejection grooves 3 are formed such that the depth of the ejection grooves 3 from the upper surface UP is larger than the depth of the non ejection grooves 4 from the upper surface UP. Each width of the ejection grooves 3 and the non ejection grooves 4 ranges from 20 μm to 100 μm. Each depth of the ejection grooves 3 ranges from 200 μm to 1 mm. Each depth of the non ejection grooves 4 ranges from 200 μm to 400 μm. The ejection grooves 3 are formed from the first side surface SP1 to a position before the second side surface SP2, while the non ejection grooves 4 are formed straight throughout the length from the first side surface SP1 to the second side surface SP2. The external shape of the dicing blade is transferred to the ends of the ejection grooves 3 on the second side surface SP2 side, wherefore these ends of the ejection grooves 3 have shapes raised toward the upper surface UP. The non ejection grooves 4 may be formed to a position before the second side surface SP2, and the ends of the non ejection grooves 4 on the second side surface SP2 side may have shapes raised toward the upper surface UP similarly to the ejection grooves 3.

In the side flow path forming step S2, the side flow path 5 is formed in the first side surface SP1 of the piezoelectric substrate 2 as illustrated in (S2*a*), (S2*b*), and (S2*c*) in FIG. 12. (S2*a*) in FIG. 12 is front view schematically illustrating the piezoelectric substrate 2 as viewed from the first side surface SP1. (S2*b*) in FIG. 12 is a cross-sectional view schematically illustrating the ejection groove 3 in the groove direction. (S2*c*) in FIG. 12 is a cross-sectional view schematically illustrating the non ejection groove 4 in the groove direction. The side flow path 5 may be formed by grinding from the first side surface SP1 of the piezoelectric substrate 2, or from the lower surface LP on the side opposite to the upper surface UP by using a dicing blade similarly to the groove forming step. The side flow path 5 is formed at the corner of the first side surface SP1 and the lower surface LP of the piezoelectric substrate 2 in such a manner as to remove the corner. In other words, the side flow path 5 is opened to both sides of the first side surface SP1 and the lower surface LP. The side flow path 5 communicates with the ends of the ejection grooves 3 on the first side surface SP1 side, but does not communicate with the non ejection grooves 4.

In a conductive material depositing step S21, a conductive material 18 is deposited on the side surfaces of the ejection grooves 3 and the side surfaces of the not-shown non ejection grooves 4 as illustrated in (S21) in FIG. 13. The conductive material 18 made of metal is deposited on the side surfaces of the ejection grooves 3 and the non ejection grooves 4 by oblique deposition to form drive electrodes 13. Each of the drive electrodes 13 is so formed as to have substantially the half of the depth of the non ejection grooves 4 from the upper surface UP. Moreover, the conductive material 18 is deposited on the upper surface UP of the piezoelectric substrate 2, which surface becomes the individual terminals 14*b* and the common terminals 14*a*. According to this embodiment, the conductive material 18 is deposited by oblique deposition on the side surfaces of the ejection grooves 3 and the non ejection grooves 4 in such a configuration as to have substantially the half of the depth of the non ejection grooves 4 from the upper surface UP. However, the present invention is not required to have this structure. For example, in the case of the chevron type piezoelectric substrate 2, the conductive material 18 may be deposited on the entire side surfaces of the ejection grooves 3 and the non ejection grooves 4 by plating.

In a resin film removing step S22, the photosensitive resin film 17 is removed, whereafter the conductive material 18 is patterned (lift-off technology) as illustrated in (S22) in FIG. 13. By this method, the common terminals 14*a* and the individual terminals 14*b* are formed on the upper surface UP in the vicinity of the second side surface SP2. Each of the common terminals 14*a* electrically connects with the drive electrodes 13 provided on both side surfaces of the corresponding ejection groove 3. Each of the individual terminals 14*b* electrically connects the drive electrodes 13 provided on the two side surfaces of the two adjoining non ejection grooves 4 between which the corresponding ejection groove 3 is sandwiched. These two side surfaces of the two adjoining non ejecting grooves 4 are located on the corresponding ejection groove 3 side. The individual terminals 14*b* and the common terminals 14*a* are connected with a flexible circuit board to receive input of driving signals from the outside.

In a cover plate bonding step S3, the cover plate 6 is bonded to the upper surface UP of the piezoelectric substrate 2 as illustrated in (S3) in FIG. 13. The cover plate 6 includes the upper liquid chamber 7 to which liquid is supplied, and the slits 8 communicating with the upper liquid chamber 7. The cover plate 6 is bonded to the upper surface UP in such a manner that the individual terminals 14*b* and the common terminals 14*a* are exposed, and that the slits 8 and the ejection grooves 3 communicate with each other. The upper liquid chamber 7 does not communicate with the non ejection grooves 4, wherefore liquid does not flow into the non ejection grooves 4.

In a lower plate bonding step S31, the lower plate 11 is bonded to the lower surface LP of the piezoelectric substrate 2 as illustrated in (S31) in FIG. 13. (S31) in FIG. 13 is a cross-sectional view schematically illustrating the ejection groove 3 in the groove direction. The lower plate 11 communicates with the side flow path 5. The lower plate 11 includes the lower liquid chamber 12*b* into which liquid flows from the side flow path 5, and the lower flow path 16 communicating with the lower liquid chamber 12*b* and discharging the liquid to the outside. The lower liquid chamber 12*b* is an area surrounded by the recessed portion 15*b* formed in the surface of the lower plate 11 on the piezoelectric substrate 2 side, and by the lower surface LP of the piezoelectric substrate 2. The lower liquid chamber 12*b* is located below the area where the ejection grooves 3 and the non ejection grooves 4 are alternately arranged, and extends throughout the length of this area in the reference direction K. The lower liquid chamber 12*b* includes a projection portion projecting from the third side surface SP3 and the fourth side surface SP4 opposed to the third side surface SP3. The lower flow path 16 is formed within the projection portion.

In a nozzle plate bonding step S4, the nozzle plate 9 is bonded to the first side surface SP1 of the piezoelectric substrate 2 as illustrated in (S4) in FIG. 13. The nozzle plate 9 includes the nozzles 10. The nozzle plate 9 is bonded in such a manner that the nozzles 10 communicate with the ejection grooves 3. The cover plate 6 and the lower plate 11 are disposed in such a condition that the ends of the cover plate 6 and the lower plate 11 are flush with the first side surface SP1. In the nozzle plate bonding step S4, the nozzle plate 9 is bonded to the end surface of the lower plate 11 to constitute the side surface of the side flow path 5.

Accordingly, required herein are only formation of the side flow path 5 on the first side surface SP1 of the piezoelectric substrate 2, and disposition of the lower plate 11 on the lower surface LP of the piezoelectric substrate 2 with the lower liquid chamber 12*b* contained in the lower plate 11. This structure allows manufacture of the liquid circulation type liquid jet head 1 by using an easy method without considerably increasing the number of parts. The side flow path forming step S2 may be performed after the cover plate bonding step S3. According to this embodiment, the resin film pattern forming step S02, the conductive material depositing step S21, and the resin film removing step S22 are performed, and then the common terminals 14*a* and the individual terminals 14*b* are formed by lift-off technology. Alternatively, the photosensitive resin film forming step S01 and the resin film pattern forming step S02 may be performed after the conductive material depositing step S21. In this case, the conductive material 18 is etched to form the common terminals 14*a* and the individual terminals 14*b* after the resin film pattern forming step S02.

According to this embodiment, the liquid jet head 1 containing a single nozzle array is produced from the single piezoelectric substrate 2. However, the liquid jet head 1 containing double nozzle arrays may be manufactured from the two piezoelectric substrates 2 whose lower surfaces LP are bonded to each other, or from two piezoelectric substrates 2 bonded to each other with the lower plate 11 sandwiched between the two piezoelectric substrates 2. In this case, the respective steps are performed in the order of the photosensitive resin film forming step S01, the resin film pattern forming step S02, the groove forming step S1, the side flow path forming step S2, the conductive material depositing step S21, and the resin film removing step S22. Then, a laminating step S5 is performed to fix the opposed lower surfaces LP of the piezoelectric substrates 2 to each other. In the subsequent cover plate bonding step S3, the cover plate 6 is bonded to each of the upper surfaces UP of the two piezoelectric substrates 2. Then, in the nozzle plate bonding step S4, the nozzle plate 9 is bonded to the first side surfaces SP1 of the two piezoelectric substrates 2.

(Eleventh Embodiment)

Figure 14:
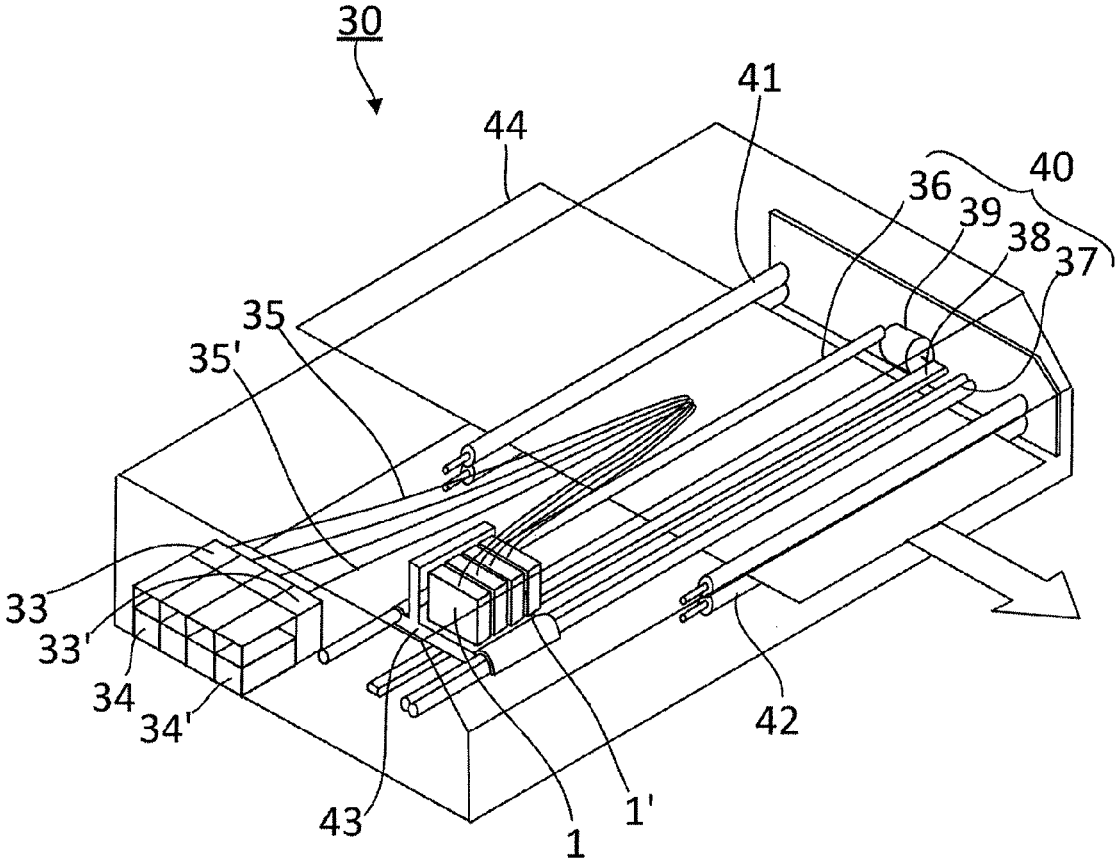
FIG. 14 is a perspective view schematically illustrating a liquid jet apparatus according to an eleventh embodiment of the present invention.
Figure 15A:
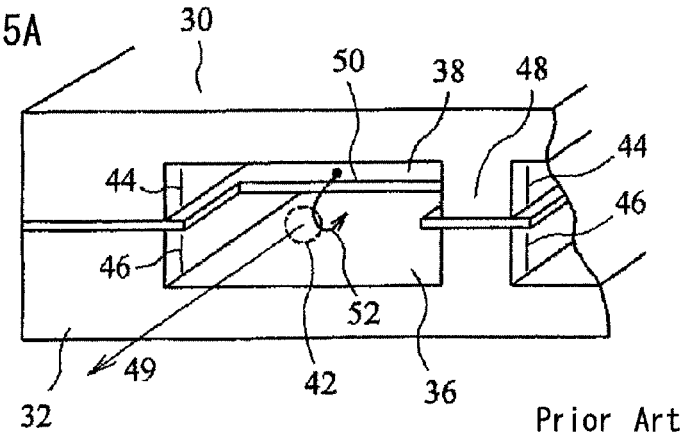
FIGS. 15A and 15B illustrate known liquid jet heads.
Figure 15B:
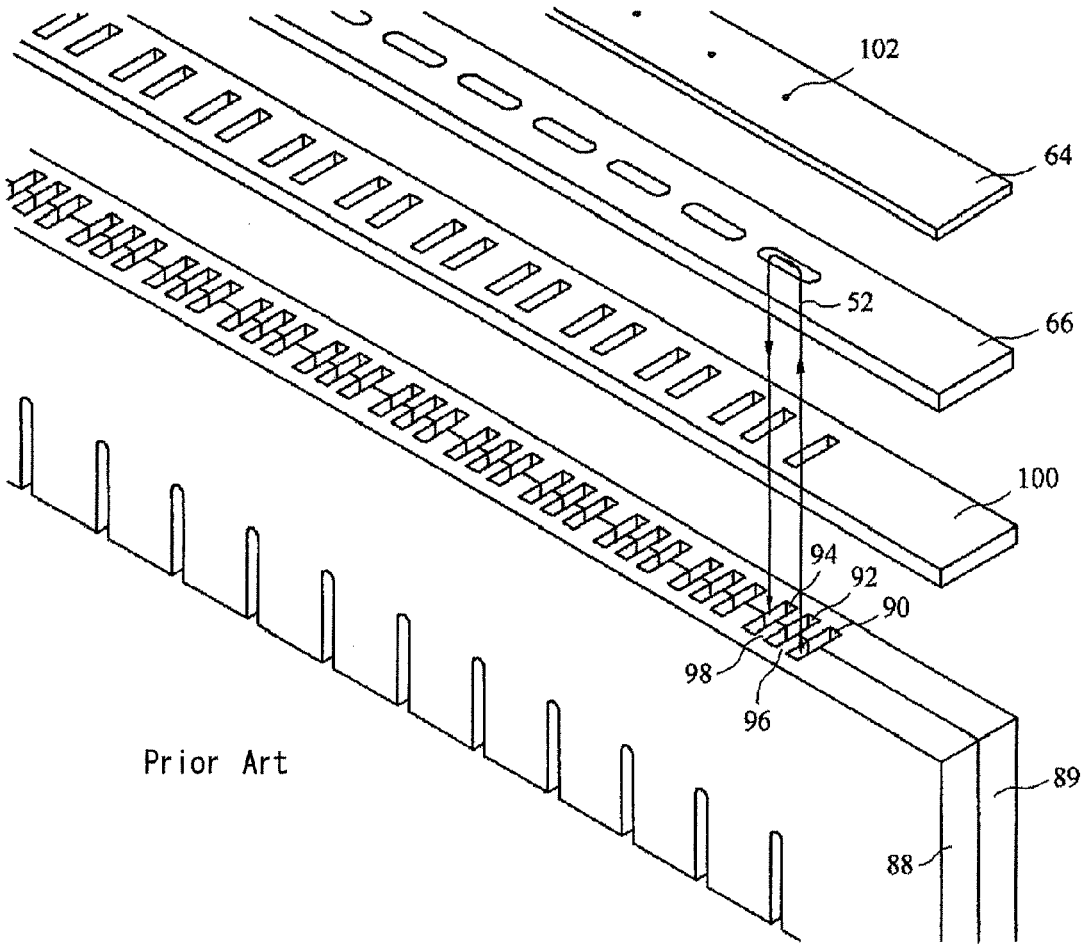

FIG. 14 is a perspective view schematically illustrating a liquid jet apparatus 30 according to an eleventh embodiment of the present invention. The liquid jet apparatus 30 includes a shift mechanism 40 capable of reciprocating the liquid jet head 1 and a liquid jet head 1', flow path units 35 and 35' supplying liquid to the liquid jet heads 1 and 1' and discharging liquid from the liquid jet heads 1 and 1', liquid pumps 33 and 33' and liquid tanks 34 and 34' communicating with the flow path units 35 and 35'. Each of the liquid jet heads 1 and 1' includes the piezoelectric substrate 2, the cover plate 6, and the nozzle plate 9. Both supply pumps for supplying liquid to the flow path units 35 and 35' and discharge pumps for discharging liquid, or either the supply pumps or the discharge pumps are provided as the liquid pumps 33 and 33' for circulating liquid. A not-shown pressure sensor and/or a not-shown flow amount sensor are provided for controlling the flow amount of liquid, if necessary. Each of the liquid jet heads 1 and 1' includes the ejection grooves 3 and the non ejection grooves 4 alternately arranged in the upper surface UP of the piezoelectric substrate 2, and further includes the side flow path 5 in the first side surface SP1 for allowing circulation of liquid. Each of the liquid jet heads 1 and 1' may be any one of the liquid jet heads discussed in the first through eighth embodiments, and manufactured by using the manufacturing method discussed in the ninth or tenth embodiment.

The liquid jet apparatus 30 includes: a pair of conveying units 41 and 42 conveying a recording medium 44 such as paper in a main scanning direction; the liquid jet heads 1 and 1' ejecting liquid to the recording medium 44; a carriage unit 43 carrying the liquid jet heads 1 and 1'; the liquid pumps 33 and 33' pressing liquid stored in the liquid tanks 34 and 34' to supply the liquid to the flow path units 35 and 35'; and the shift mechanism 40 allowing scanning by the liquid jet heads 1 and 1' in a sub scanning direction perpendicular to the main scanning direction. A not-shown controller controls driving of the liquid jet heads 1 and 1', the shift mechanism 40, and the conveying units 41 and 42.

Each of the pair of the conveying units 41 and 42 includes a grid roller and a pinch roller extending in the sub scanning direction, and rotatable while bringing the respective roller surfaces into contact with each other. A not-shown motor moves the grid roller and the pinch roller around shafts to convey the recording medium 44 sandwiched between the respective rollers in the main scanning direction. The shift mechanism 40 includes a pair of guide rails 36 and 37, a carriage unit 43 capable of sliding along the pair of the guide rails 36 and 37, an endless belt 38 connected with the carriage unit 43 and shifting the carriage unit 43 in the sub scanning direction, and a motor 39 revolving the endless belt 38 via a not-shown pulley.

The carriage unit 43 carries the plurality of liquid jet heads 1 and 1', and ejects four types of droplets in yellow, magenta, cyan, and black, for example. The liquid tanks 34 and 34' store liquid in the corresponding colors, and supply the liquid to the corresponding liquid jet heads 1 and 1' via the liquid pumps 33 and 33', and the flow path units 35 and 35'. The respective liquid jet heads 1 and 1' eject droplets in the corresponding colors in accordance with driving signals. Recording of arbitrary patterns on the recording medium 44 is achieved by controlling the timing for ejection of liquid from the liquid jet heads 1 and 1', the revolutions of the motor 39 driving the carriage unit 43, and the conveying speed of the recording medium 44.

According to the liquid jet apparatus 30 in this embodiment, the shift mechanism 40 shifts both the carriage unit 43 and the recording medium 44 for recording. Alternatively, the liquid jet apparatus may be such a type which fixes the carriage unit, and shifts the recording medium two dimensionally using the shift mechanism for recording. In other words, the shift mechanism is only required to shift the liquid jet head and the recording medium relatively to each other.

What is claimed is:

1. A liquid jet head comprising:

a piezoelectric substrate which includes ejection grooves formed in an upper surface of the piezoelectric substrate and arranged in a reference direction for ejecting liquid, and a side flow path formed in a first side surface of the piezoelectric substrate and communicating with the plurality of ejection grooves so that liquid from the ejection grooves enters into the side flow path;

a cover plate bonded to the upper surface; and a nozzle plate bonded to the first side surface and including nozzles communicating with the ejection grooves for ejecting liquid droplets.

2. The liquid jet head according to claim 1, wherein the piezoelectric substrate includes non ejection grooves arranged such that the ejection grooves and the non ejection grooves are alternately disposed, and the non ejection grooves do not communicate with the side flow path.

3. The liquid jet head according to claim 2, wherein the depth of the non ejection grooves from the upper surface is smaller than the corresponding depth of the ejection grooves.

4. The liquid jet head according to claim 2, wherein the non ejection grooves extend from the first side surface of the piezoelectric substrate to a second side surface opposed to the first side surface.

5. The liquid jet head according to claim 1, wherein the ejection grooves extend from the first side surface of the piezoelectric substrate to a position before the second side surface opposed to the first side surface.

6. The liquid jet head according to claim 1, wherein the side flow path is opened to a lower surface of the piezoelectric substrate on the side opposite to the upper surface.

7. The liquid jet head according to claim 1, wherein the side flow path extends between positions before a third side surface and a fourth side surface, the third side surface and the fourth side surface being disposed adjacent to the first side surface and opposed to each other.

8. The liquid jet head according to claim 1, wherein a first lower liquid chamber formed by a recessed portion is included in the lower surface of the piezoelectric substrate on the side opposite to the upper surface, and the first lower liquid chamber communicates with the side flow path.

9. The liquid jet head according to claim 1, wherein the cross-sectional shape of the side flow path in the direction perpendicular to the reference direction is expanded from the ejection grooves toward the lower surface on the side opposite to the upper surface.

10. The liquid jet head according to claim 1, comprising a lower plate which includes a second lower liquid chamber communicating with the side flow path, and is bonded to the lower surface of the piezoelectric substrate on the side opposite to the upper surface.

11. The liquid jet head according to claim 1, wherein the piezoelectric substrate includes a first piezoelectric substrate and a second piezoelectric substrate, the cover plate includes a first cover plate and a second cover plate, a lower surface of the first piezoelectric substrate and a lower surface of the second piezoelectric substrate are opposed and fixed to each other, a side flow path of the first piezoelectric substrate and a side flow path of the second piezoelectric substrate communicate with each other, the first cover plate is boded to an upper surface of the first piezoelectric substrate, and the second cover plate is bonded to an upper surface of the second piezoelectric substrate.

12. The liquid jet head according to claim 11, wherein the lower surface of the first piezoelectric substrate and the lower surface of the second piezoelectric substrate are bonded to each other.

13. The liquid jet head according to claim 11, comprising a lower plate which is provided between the first piezoelectric substrate and the second piezoelectric substrate, and includes a second lower liquid chamber communicating with the side flow path.

14. The liquid jet head according to claim 1, wherein the arrangement pitch of the ejection grooves of the first piezoelectric substrate in the reference direction is equalized with the arrangement pitch of the ejection grooves of the second piezoelectric substrate in the reference direction, and the respective arrangement pitches deviate from each other in the reference direction by the half of the pitch for each.

15. A liquid jet apparatus comprising:

a liquid jet head according to claim 1;

a shift mechanism for shifting the liquid jet head and a recording medium relatively to each other;

a liquid supply pipe for supplying liquid to the liquid jet head; and a liquid tank for supplying the liquid to the liquid supply pipe.

* * * * *